US005355555A

United States Patent [19]

Zarelius

[11] Patent Number: 5,355,555

[45] Date of Patent: Oct. 18, 1994

[54] ELONGATED BENDABLE DEVICE

[76] Inventor: Christer Zarelius, Skeppargatan 29, 114 52 Stockholm, Sweden

[21] Appl. No.: 983,850

[22] PCT Filed: Sep. 16, 1991

[86] PCT No.: PCT/SE91/00618

§ 371 Date: Mar. 2, 1993

§ 102(e) Date: Mar. 2, 1993

[87] PCT Pub. No.: WO92/05331

PCT Pub. Date: Apr. 2, 1992

[30] Foreign Application Priority Data

Sep. 18, 1990 [SE] Sweden ..... 9002966-1

[51] Int. Cl.[5] ..... E05D 1/02

[52] U.S. Cl. ..... 16/225; 16/382; 160/135

[58] Field of Search ..... 16/225, 227, 382; 52/70, 71, 464; 160/135, 231.1

[56] References Cited

U.S. PATENT DOCUMENTS

| | | | |
|---|---|---|---|
| Re. 28,672 | 1/1976 | Wakeman . | |
| 1,196,244 | 8/1916 | Kinoshita | 16/227 |
| 2,096,559 | 10/1937 | Riley | 16/225 |
| 3,751,760 | 8/1973 | Wakeman | 16/227 |
| 3,851,353 | 12/1974 | Wakeman . | |
| 3,913,656 | 10/1975 | Guyer | 16/227 |
| 3,925,136 | 12/1975 | Wakeman . | |

FOREIGN PATENT DOCUMENTS

| | | | |
|---|---|---|---|
| 2101526 | 1/1971 | Fed. Rep. of Germany . | |
| 2339724 | 8/1977 | France | 16/225 |
| WO88/08186 | 10/1988 | PCT Int'l Appl. . | |
| 333523 | 3/1971 | Sweden . | |
| 437053 | 2/1985 | Sweden . | |

*Primary Examiner*—Lowell A. Larson
*Assistant Examiner*—Donald M. Gurley
*Attorney, Agent, or Firm*—Burns, Doane, Swecker & Mathis

[57] ABSTRACT

A hinge strip forms a hinge arrangement comprising a plurality of edge related segments, oriented between two mutually adjacent elements, normally in the form of two flat panels, the strip having at least one surface coated with a respective adhesive layer for adhesion to at least one of an edge region and an edge surface of a respective element, the hinge strip being divided along its edge surface into segments by exposing a number of mutually spaced segments separating weakenings, which are arranged to extend transversely to a longitudinally extending center line or a hinge rotation line, each segment having a nonadhesive surface region which is positioned between two adjacent adhesive surface regions, a non-adhesive surface region of adjacent edge segments being located on alternating sides of a hinge line.

15 Claims, 3 Drawing Sheets

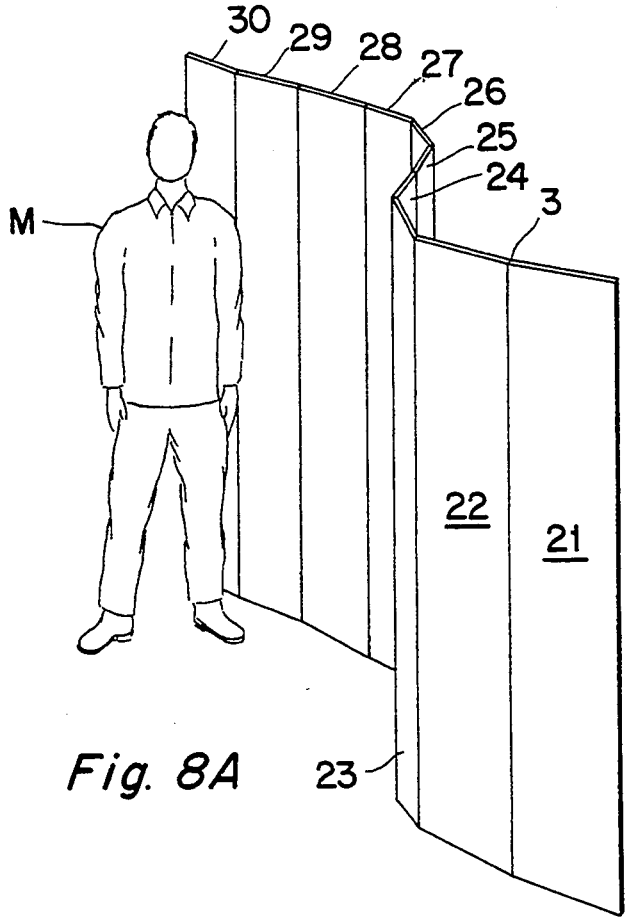
Fig. 8A
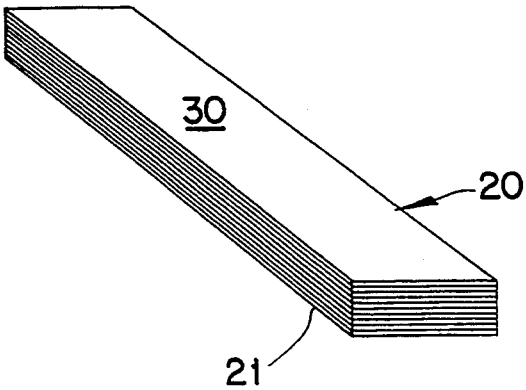
Fig. 8B
Fig. 8C
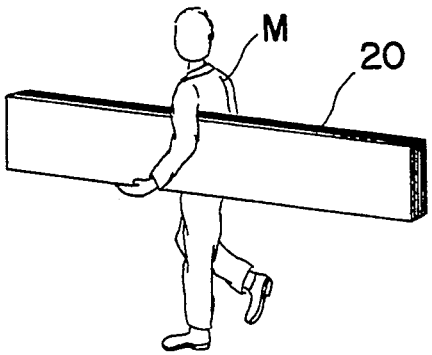

ELONGATED BENDABLE DEVICE

TECHNICAL FIELD

The present invention relates to an elongated bendable device or hinge strip and then particularly to such a device or hinge strip which functions to form a hinge between two mutually adjacent elements, normally between two mutually adjacent panels.

Each of the two outer margins of the hinge strip device is coated with an adhesive layer, or alternatively an adhesive layer is applied over the whole of the hinge strip, so as to enable the strip to be bonded firmly to an edge region and/or an edge surface of a respective element or panel.

Alternatively, the edge region and/or the edge surface of respective elements or panels may be coated with an adhesive, so as to enable the outer margins of the hinge strip to be affixed to said region or said surface.

The present invention finds particular use as a hinge means for portable and/or temporary display systems or the like, where said hinge means is intended to provide a connection between an edge part of a first panel and an adjacent edge part of a second panel adjacent said first panel, with a minimum visible joint therebetween.

More particularly, the present invention provides a hinge means which can be used in portable display systems of the kind which include a plurality of panels which are positioned edge-to-edge in side-by-side relationship and which are mutually joined by means of one or more hinges, said panels consisting of or at least substantially consisting of a plate.

Other types of panels can also be used, such as panels which are made of particle board, plexiglass®, standard glass and like materials.

Portable display systems of this nature are used extensively to expose text and pictures, particularly large pictures, which requires the provision of a plurality of panels positioned side-by-side with only a narrow join therebetween, so as to enable the complete picture to be shown.

A panel of this nature normally comprises lightweight plate or sheet of sandwich-construction, for example a plate retailed by Schneidler under the tradename "KAPA-skivan".

BACKGROUND ART

The use of a pliable strip as a hinge means is known from many mutually different applications. By way of example, reference can be made to U.S. Pat. No. 1,196,244 which teaches one such hinge means in which the mutually opposing edge surfaces intended for respective sections have a V-shape and are provided with longitudinally extending tape-accommodating apertures or recesses.

A hinge means which can be considered to closely approach the inventive device is illustrated and described in the German published specification No. 2,101,526.

With regard to the significant features of the present invention, the construction which lies nearest the inventive hinge strip is a piece of adhesive tape which has been applied to the edge surfaces of two mutually adjacent panels with the panels positioned so that their edge surfaces are located in one and the same plane.

In this case, the adhesive layer on the tape will not cover solely the mutually opposing edge regions of the two elements but will also cover mutually adjacent edge surfaces and the adhesive tape used will thus form a hinge means having one single pivot axis, which is located at the edge between edge surface and edge region and in the vicinity of that edge region which is not caused to coact with the adhesive tape, and therewith provides a hinge means which will allow the panels to be rotated solely through 180°.

Further examples of earlier known hinge means are found illustrated and described in Swedish Patent Specification No. 333 523, U.S. Pat. No. 3,751,760 and International Patent Application, publication No. W088/08186, which teaches a hinge means that consists of at least three tape-like components or segments. These tape-like components are attached to a lightmetal frame belonging to a first plate or sheet and to an adjacent lightmetal frame belonging to an adjacent second plate or sheet.

DISCLOSURE OF THE PRESENT INVENTION

Technical Problems

When considering the known prior art as described above, it will be seen that a technical problem resides in the provision of an adhesive tape which has selected adhesive regions and selected non-adhesive regions and which can be readily affixed to the edge surfaces and the edge regions of two mutually adjacent elements or panels and with which adhesion of the tape to said elements or panels is effected in a manner such that the rotational axis and rotational line of the hinge is either located within or adjacent to one or the other edge region of said element, depending on the bending direction of said hinge and with which the bending principle will conform with the principle illustrated and described in the earlier mentioned German published specification No. 2,101,526, so as to obtain a hinge which will enable the panels to be rotated through an angle of up to 360°.

Another technical problem resides in the provision of an elongated bendable device or hinge strip with which certain selected surface areas will lack adhesion and therewith not fasten to adjacent elements, and to realize the significance of this in constructing a simple hinge means.

It will also be seen that a technical problem resides in the ability to realize the significance of providing the elongated, bendable device or hinge strip with transversely extending, segment-forming weakenings which will not only facilitate application of the device to the edge surfaces and edge regions of a respective element but will also provide a hinge that enables said elements to be swung through an angle of 360°.

Another technical problem is one of realizing the significance of forming said weakenings in a predetermined spaced relationship.

Still another technical problem is one of realizing the significance of allowing a first adhesive or non-adhesive region belonging to one segment to be positioned adjacent a first element and to allow a second adhesive or non-adhesive region belonging to an adjacent segment to be positioned adjacent a second element and therewith provide conditions for a hinge function which will resist lateral forces that act on the panels adjacent the hinge.

Another technical problem in the present context is one of realizing the significance of the shape given to the segment-separating weakenings whether or not these weakenings shall have the form of recesses, slots, perforations or the like, while, at the same time, realizing the significance of dimensioning the transverse extension of respective weakenings in relation to the total width of the tape.

A further technical problem is one of realizing the significance of spacing adjacent weakenings so far apart and of making the segment so long as to at least correspond to more than three times the thickness of the element, thereby to obtain a sufficiently large adhesive surface, and to adapt the number of weakenings to the panel material and to the surface structure of the panel material.

It will also be seen from the aforementioned earlier standpoint of techniques that a technical problem resides in the provision of a specially prepared hinge strip which, similar to earlier known devices, can be applied to two flat elements or panels which are positioned closely adjacent one another with the edge surfaces of said elements located in one and the same plane.

When studying the earlier known art, as described above, it will also be seen that a technical problem resides in the provision of a simpler portable or temporary display system which will not require the presence of a lightmetal frame in order to secure a thin pliable panel to a similar panel.

A further technical problem is one of realizing the significance of using a (rectangular) sheet having along one short side thereof sufficient rigidity to form part of a portable display system without needing to be supported to any appreciable extent and which has along one long side thereof, or the hinge side thereof, a rigidity which is scarcely sufficient for a portable display system and which therefore requires to be stiffened through the intermediary of the hinge means.

It will also be seen that a technical problem is one of being able to provide a portable display system whose weight is considerably less than the weight of a display system that comprises panels provided with lightmetal frames.

It will also be seen that a technical problem lies in realizing the significance of constructing a hinge device which will function to stiffen mutually adjacent panels and thereby afford a flexurally rigid connection at different angles between the mutually adjacent panels, with an invisible or at least minimum joints therebetween.

It will also be seen that a technical problem resides in realizing the advantages that are afforded when normally, but not necessarily, choosing a panel thickness which is slightly larger than the thickness required for panels enclosed in lightmetal frames and by realizing the significance of choosing a panel which is so thin as to require additional stiffening along its longer edge part, by utilizing a hinge in the form of tape, preferably transparent adhesive tape, so as to provide a collapsible display system comprising more than two panels with a minimum join therebetween.

Finally, it will be seen that a technical problem resides in the provision of conditions which will prevent the hinge from being seen on the front side of the panels and which can scarcely be seen on the rear side of said panels, when the hinge means is produced from transparent adhesive plastic tape.

Solution

The present invention is based on the ability to construct an elongated bendable device or hinge strip capable of forming a hinge between two mutually adjacent elements, normally two flat panels, where at least the outer parts of said hinge are each coated with an adhesive layer intended to be fastened to an edge region and/or edge surface of a respective element.

Alternatively, the edge region and/or edge surface of a respective element can be provided with an adhesive coating for bonding to the outer parts of the device.

According to the present invention, the bendable device or strip is divided into segments. For each segment, a first surface area which lacks adhesive properties is positioned between two adjacent second and third surface areas which have adhesive properties. A first surface area of a segment is positioned on one side of a hinge rotational line while a first surface area of an adjacent segment is positioned on the other side of said rotational line.

According to further embodiments, the second and third surface areas of a segment are integrated with second and third surface areas of adjacent segments.

According to another embodiment, the elongated device or hinge strip is provided with segment-separating weakenings which extend transversely to the longitudinal centre line or rotational line, for instance weakenings in the form of recesses, slots, perforations or the like. The weakenings are spaced mutually apart and a non-adhesive region intended for a first element and extending along the centre line or rotational line on one side of said line and located between two weakenings is displaced laterally-in relation to a second non-adhesive region which is intended for a second element and which extends along said centre line or rotational line on the other side of said line.

As further embodiments which lie within the scope of the invention, it is also suggested that the weakenings are mutually equidistant along the whole of the edge surface of said element.

With regard to said weakenings, it is suggested, in accordance with the invention, that the extension of the weakenings across the tape or band is equal to or slightly greater than the total thickness of the two elements.

Preferably, the weakenings will have an extension which covers the width of the tape or band to 80% or less.

The distance between mutually adjacent weakenings will preferably be more than three times the thickness of the element.

Advantages

Those advantages primarily afforded by the inventive hinge strip reside in the ability to apply the strip to two flat elements when the elements are located close together with the edge surfaces thereof located in one and the same plane, in the same manner as a conventional adhesive tape can be applied to the edge surfaces or edge regions of two flat elements, although with the advantage that the hinge means will provide a hinge function which conforms to the hinge function described and illustrated in the aforesaid German published specification No. 2,101,526 with straight edge surfaces for the two elements.

Furthermore, the invention enables a display system comprising a plurality of panels, more than two panels, to be folded together with the aid of simple 360°-hinges and transported away and subsequently readily erected to provide a display system on which a picture or pictures can be presented without the display stand showing any joints between the adjacent panels, or said joints only being slightly discernible.

A further advantage is that the ability of the hinge means to rotate through 360° enables the mutually connected panels to be collapsed together in a zig-zag fashion and because only the edge region of one side is covered by the hinge strip enables text to be presented on the other side without the presence of disturbing, discernible joints.

The inventive elongated bendable device or hinge strip is mainly characterized by the characteristic features set forth in the characterizing clause of the following claim 1.

BRIEF DESCRIPTION OF THE DRAWINGS

An exemplifying embodiment of the invention at present preferred will now be described in more detail with reference to the accompanying drawings, in which

FIGS. 8A, 8B and 8C illustrate a portable display system comprising ten rectangular panels and shows the system collapsed and extended in a zig-zag fashion.

DESCRIPTION OF EMBODIMENTS AT PRESENT PREFERRED

Figure 1:
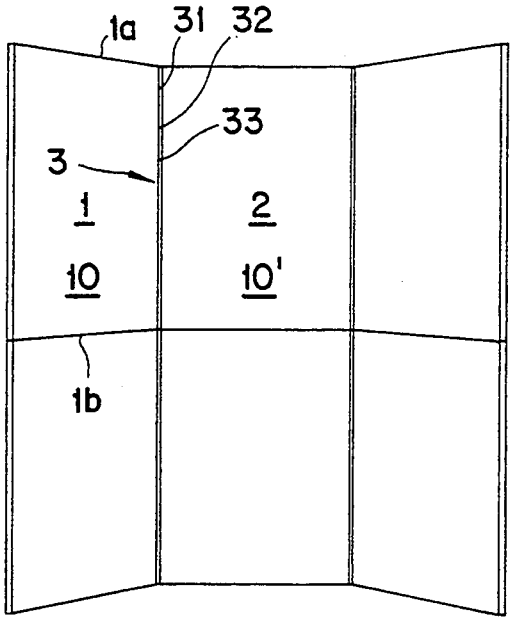
FIG. 1 illustrates schematically an erected display system which comprises six panels and where the edge surface of one panel, or one element, coacts with an adjacent edge surface of an adjacent panel or element through the intermediary of an elongated bendable device which functions as a hinge means in accordance with the present invention and which includes a number of segments.

Shown in FIG. 1 is a portable display system which comprises six panels arranged in rows and columns.

The panels, or elements, are mutually identical and it will be understood that, in practice, the display system need not be restricted to six panels but may comprise any number of panels of any desired outer shape. (See for instance FIGS. 8A, 8B and 8C).

Since the panels are mutually identical, the following description will be made solely with reference to the coaction between panels 1 and 2.

Thus, there is shown in FIG. 1 a panel 1 which is intended for a portable display system and then particularly for a display system of the kind which includes a plurality of panels or elements positioned side-by-side and edge-to-edge and mutually jointed by means of one or more hinges.

Each panel 1 consists of a sheet or plate 10, 10' and the panels are mutually joined by means of an elongated, bendable device or hinge strip 3 which, in the present case, consists of a transparent adhesive tape, although other forms of tape and bands can be used.

It is proposed that one and the same length of adhesive tape 3 extends from the upper part 1*a* of the panel 1 to its lower part 1*b* and forms a number of segments 31, 32, 33 therebetween.

In the illustrated embodiment, the hinge strip 3 comprises a strip of transparent adhesive tape 3 which is sufficiently strong to form a hinge between two mutually adjacent, flat panels 10, 10'.

Figure 2A:
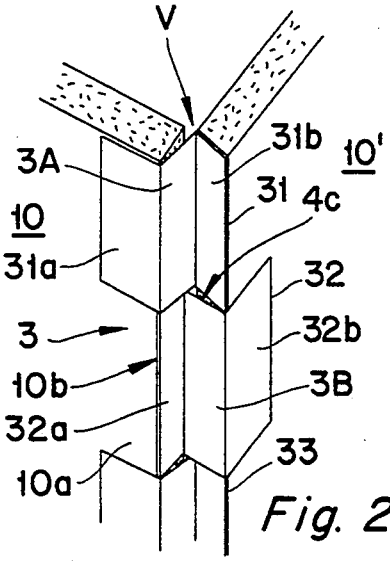
FIG. 2A is a perspective view of a part of an elongated bendable device having minimized adhesive surface areas and coacting with two panels rotated through about 90°.

FIG. 2A illustrates the principle of dividing the hinge strip 3 into a plurality of segments, although only three such segments 31, 32 and 33 are shown in the Figure.

Each segment 31 has a non-adhesive first surface region 3A which is positioned between two adjacent adhesive second and third surface regions 31*a* and 31*b*, wherein a first surface region 3A of a segment 31 is positioned on one side, the left-hand side, of a rotational hinge line "V", whereas a first surface region 3B of an adjacent segment 32 is positioned on the other side, the right-hand side, of said hinge line "V" and is defined by second and third surface regions 32*a* and 32*b* respectively.

Figure 2B:
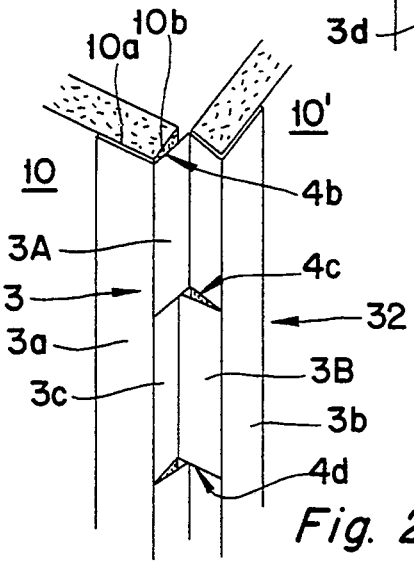
FIG. 2B illustrates in perspective a part of an elongated bendable device which is more appropriate from the aspect of manufacture and which coacts with two mutually adjacent panels, which are shown rotated to a mutual angle of about 90°.

In the FIG. 2B illustration, the respective second and third surface regions 31*a* and 31*b* of a segment 31 are integrated with respective second and third surface regions 32*a* and 32*b* of an adjacent segment 32.

Each of the two parallel outer margins 3*a*, 3*b* of the tape 3 shown in FIG. 2B are coated with an adhesive layer 3*a'*, 3*b'* on the surfaces that face towards the panels 10, 10', these adhesive layers being intended to fasten to the edge region of a respective panel 10, 10'. FIG. 2B shows one such edge region 10*a* of the panel 10.

A defined or limited part 3*c* having an adhesive layer 3*c'* is intended to fasten against the edge surface 10*b* of the panel 10.

It will be obvious to the person skilled in this art that it also lies within the scope of the invention to coat the edge region 10*a* and/or the edge surface 10*b* of respective elements or panels with an adhesive layer and to fasten thereto a non-adhesive tape or like strip, and then particularly its outer extremities.

The hinge strip or tape 3 has formed thereon a number of segment-separating weakenings 4, 4*a*, 4*b*, 4*c* and 4*d* which extend transversely to the longitudinal centre line or hinge line 3*d* of the tape.

In the case of the illustrated embodiment, these weakenings consist of apertures, such as narrow slots, although it lies within the scope of the invention to perforate the tape or strip-with apertures of other configurations.

The weakenings are spaced apart at a predetermined distance "a". In the case of the illustrated embodiment, the weakenings are mutually equidistant and are spaced apart at a distance equal to seven times the thickness of the panel 10.

It is assumed in the following that the end surface of the tape or strip 3 represents a weakening (4*b*).

A first, non-adhesive region 3A is positioned along the centre line 3*d* or hinge line 3*d*, on one side of said line and extends between two weakenings 4*b* and 4*c*, said first region being intended to face towards the edge surface 10*b* of the first panel 10.

This region 3A is displaced laterally relative to the rotational hinge line 3*d* and is followed by a second region 3B which is located between two weakenings 4*c* and 4*d* and which also extends along the centre line or hinge 3*d* but is offset relative to said line on the other side thereof. This second region 3B also lacks adhesive and is intended to face towards the edge surface 10*b*′ of the second panel 10′.

Figure 5:
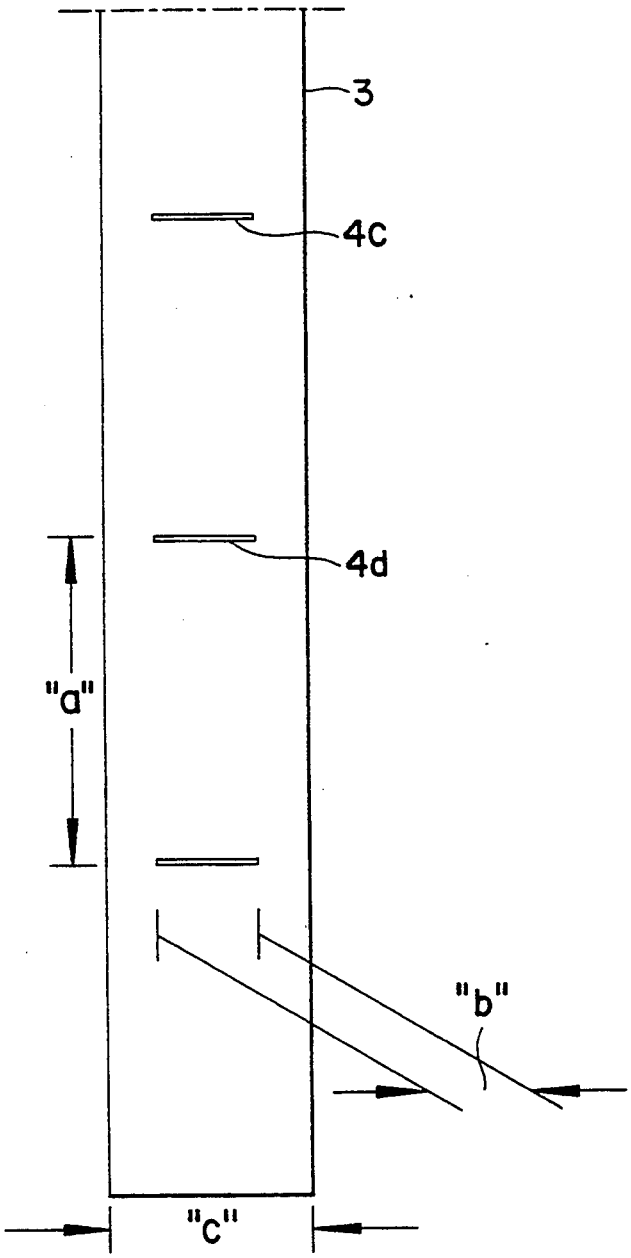
FIG. 5 is a top view of the non-adhesive side of an elongated bendable device according to FIG. 2B, in which weakenings, such as recesses or slots have been formed.
Figure 6:
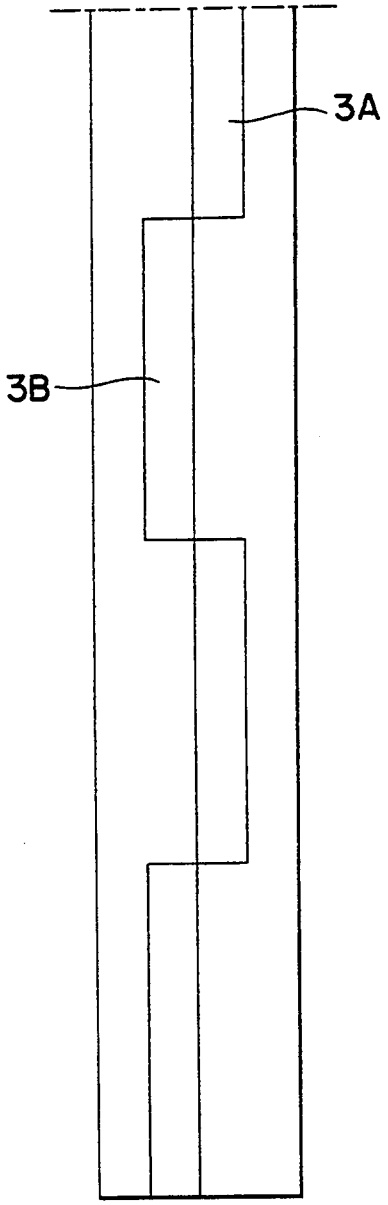
FIG. 6 is a top view of the adhesive side of the elongated bendable device according to FIG. 5 and illustrates a sequence of manufacturing steps immediately prior to forming the slots.

As will best be seen from FIG. 5, the weakenings 4*c* and 4*d* have an extension "b" across the tape 3 which is equal to or slightly greater than the total thickness of the two panels 10, 10′.

The weakenings have also been given a transverse dimension which extends 80% or less of the total width "c" of the tape.

The distance between mutually adjacent weakenings 4*c*, 4*d* corresponds to more than three times the thickness of the panel 10.

Figure 4:
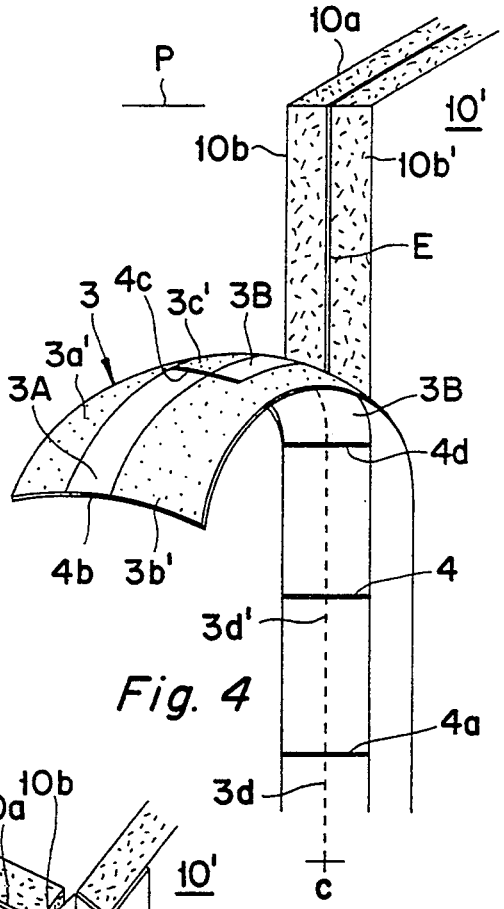
FIG. 4 illustrates the principle of applying an elongated bendable device according to FIG. 2B in the form of an adhesive tape to two mutually adjacent panels or elements with the edge surfaces positioned in one and the same plane.

As illustrated in FIG. 4, the tape 3 is applied simultaneously to two flat panels 10, 10′ with said panels being located or positioned close together and with the edge surfaces 10*b*, 10*b*′ located in one and the same plane P.

It is suggested, in accordance with the invention, that line 3*d*′ is imprinted on the tape 3 and that when affixing the tape, said line is positioned in the defining surface between the panels 10 and 10′ such as to form said rotational hinge line.

Figure 7:
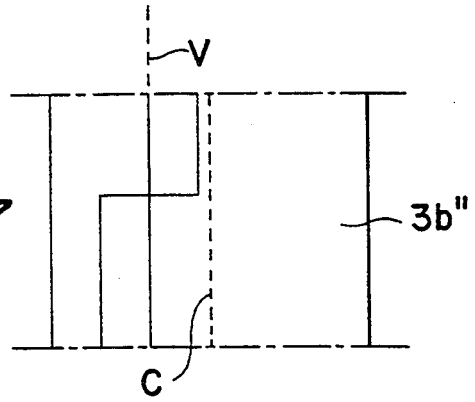
FIG. 7 illustrates a short section of a elongated bendable device in which a rotational hinge line is laterally displaced in relation to a central line.

As illustrated in FIG. 7, the elongated, bendable device or hinge strip can be given an asymmetric construction, such that a centre line "C" will be located on one side of the hinge line "V".

Figure 3A:
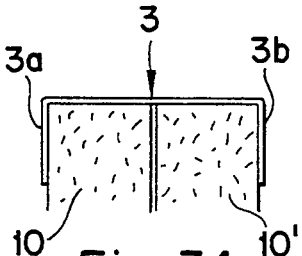
FIG. 3 illustrates in different sequences, A–D, a number of rotational positions of a 360°-hinge according to the invention.
Figure 3B:
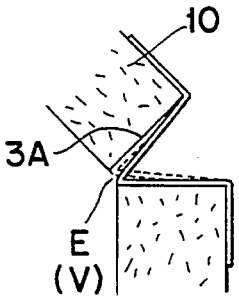
Figure 3C:
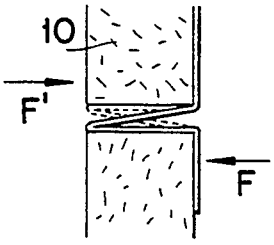

FIGS. 3A, 3B, 3C and 3D are section views of the hinge strip, with FIG. 3C showing the panels 10, 10′ slightly displaced from one another, so as to show the features of the inventive hinge more clearly.

It will be seen that the tape 3 is affixed to only one side of the panels and that when an adhesive part is fastened to one edge surface, an opposite part is not fastened to an opposing edge surface.

Certain circumstances relating to the invention should be explained more clearly.

It is well known that the adhesive tape used may include different adhesive layers, from layers of strong adhesive to layers of weak adhesive.

It is also known that different materials and different surface structures will provide different degrees of tape adhesion.

It is also known that the adhesion of adhesive tape is more readily released at the tape edges.

These circumstances are taken into account when choosing the number of segments having the length or distance "a" for a hinge means working under selected conditions.

If this distance is too small and if too many segments are provided, more edge regions will be obtained, whereas if said distance is too large, the hinge will become unstable.

With regard to the distance "b", it should be understood that when this tape distance is equal to twice the thickness of the panel or unit, the tape can be used effectively for thinner panels.

When using a prefabricated tape for thinner panels, the regions 3A and 3B will extend along the edge region of the panels, such as the region 3A which extends some distance over the edge region 10*a*.

If there are used two panels which have mutually different tape-adhering properties, it is proposed that the tape is configured in accordance with FIG. 7, such that the panel surface of lower adhesion is covered with a broader adhesive layer 3*b*″.

It should be mentioned that the inventive hinge is highly stable to forces which act in the directions F and F′ in FIG. 3C.

FIGS. 3A, 3B, 3C and 3D illustrate the hinge which can be pivoted or rotated through more than 360°, and FIG. 3A shows a tape 3 applied to two panels 10, 10′ of equal thickness and positioned in accordance with FIG. 4.

FIG. 3B shows the panel 10 rotated through 135° around a rotational axis "E" or "V".

FIG. 3C shows the panels 10 and 10′ in one and the same plane, although slightly separated for the purpose of illustration.

Figure 3D:
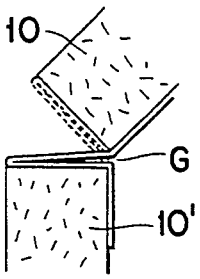

FIG. 3D illustrates the panel 10 rotated through a further 45° about a new further rotational axis "G" located on the rear side of the panels or on the side to which the tape is affixed.

It will be seen that the panel 10 can be rotated further around the axis "G", to a position in which the panel is rotated through 360° in relation to the panel position shown in FIG. 3A.

Finally, FIGS. 8A, 8B and 8C illustrate a portable display system collapsed to form a package 20 and carried by a person "M", the panels of said system having a slightly different shape from the panels illustrated in FIG. 1.

The collapsed system 20 can be extended to enable a picture or text to be shown on the ten panels included in the system, with said picture or text covering the panel joins.

Some of the panels, 21–22, are positioned in a straight line, whereas the panels 23 and 24 are positioned in a convex, curved line. The panels 25 and 26 are positioned in a concave, curved line, whereas the panels 27, 28, 29 and 30 are positioned in a straight line.

Each panel is joined to an adjacent panel by means of a hinge strip 3 and the panel joints are therewith practically unnoticeable.

The panel joints are more noticeable in the case of those panels that are positioned along a convex, curved line.

As illustrated in the Figure, the panels 21–30 can be folded together in a zig-zag fashion to form the package 20.

Although different tapes having different backing materials and different types of adhesive layers can be used, it is preferred to use an adhesive layer having an adhesion corresponding to the adhesive retailed under the tradename "Tesafix 4965". The backing or substrate material should be sufficiently thin, however, so as to give a distinctive fold and therewith form a hinge line.

It will be understood that the invention is not restricted to the aforedescribed exemplifying embodiment thereof and that modifications can be made within the scope of the invention as defined in the following claims.

It is to be noted that although the embodiments shown have an end surface directed perpendicular to the planar surface of the panel it is obvious that said end surface can be formed with an other angle. Thus the panels may be arranged in a curved pattern with end surfaces arranged adjacent each other and parallel to each other.

What is claimed is:

1. A hinge strip for forming a hinge arrangement having a plurality of edge related segments oriented between two mutually adjacent elements, normally in the form of two flat panels, the hinge strip comprising a single layer of flexible material having at least one surface coated with a respective adhesive layer for adhesion to at least one of an edge region and an edge surface of a respective element, the hinge strip being divided longitudinally into segments by a plurality of spaced apart segment-separating weakenings which extend transversely to a longitudinally extending hinge rotation line, each segment having a non-adhesive surface region positioned between two transversely adjacent adhesive surface regions adapted to be adhered to a respective side region of one element and an edge region of the other element, wherein a non-adhesive surface region of a first segment being located on one side of and adjacent to the hinge rotation line, and a first surface region of an adjacent segment is located on the other side of and adjacent to said hinge rotation line.

2. A hinge strip according to claim 1, wherein a non-adhesive and two adhesive segment surface regions of a first segment are integrated with a non-adhesive and two adhesive surface regions of an adjacent segment.

3. A hinge strip according to claim 2, wherein the segment-separating weakenings are formed as one of recesses, slots, and perforations and wherein a non-adhesive region of a first segment extends between two weakenings and is located on one side of said hinge rotation line offset laterally in relation to a second non-adhesive region of a second segment extending between two weakenings and located on the other side of said hinge rotation line.

4. A hinge strip according to claim 3, wherein said hinge strip is adapted to be applied to two flat elements with said elements located close together and with the edge surfaces of said elements located in one and the same plane.

5. A hinge strip according to claim 3, wherein the tape is provided with a centering line for positioning the hinge strip on said elements.

6. A hinge strip according to claim 1, wherein the segment-separating weakenings are formed as one of recesses, slots, and perforations and wherein a non-adhesive region of a first segment extends between two weakenings and is located on one side of said hinge rotation line offset laterally in relation to a second non-adhesive region of a second segment extending between two weakenings and located on the other side of said hinge rotation line.

7. A hinge strip according to claim 6, wherein the weakenings are spaced equidistantly along the surface region of the hinge strip.

8. A hinge strip according to claim 6, wherein the weakenings have a transverse extension which is equal to or slightly greater than the total thickness of the elements.

9. A hinge strip according to claim 6, wherein the weakenings have an extension which covers no more than 80% of the strip width.

10. A hinge strip according to claim 6, wherein the distance between adjacent weakenings corresponds to more than three times the thickness of an element.

11. A hinge strip according to claim 1, wherein said strip is applied to two flat elements with said elements located close together and with the edge surfaces of said elements located in one and the same plane.

12. A hinge strip according to claim 1, wherein the tape is provided with a centering line or the like.

13. A hinge strip according to claim 6, wherein the strip is adapted to be applied to two flat elements with said elements located close together and with the edge surfaces of said elements located in one and the same plane.

14. A hinge strip according to claim 6, wherein the tape is provided with a centering line for positioning the hinge strip on said elements.

15. A hinge strip according to claim 1, wherein in each segment, one of said adhesive surface regions has a greater transverse dimension than the other adhesive surface region.

* * * * *